United States Patent [19]

Goll

[11] Patent Number: 4,510,282

[45] Date of Patent: Apr. 9, 1985

[54] AQUEOUS DISPERSIONS FOR COATING MATERIALS

[75] Inventor: Werner Goll, Garching, Fed. Rep. of Germany

[73] Assignee: SKW Trostberg Aktiengesellschaft, Trostberg, Fed. Rep. of Germany

[21] Appl. No.: 491,345

[22] Filed: May 10, 1983

Related U.S. Application Data

[63] Continuation of Ser. No. 340,472, Jan. 18, 1982, abandoned.

[30] Foreign Application Priority Data

Jan. 23, 1981 [DE] Fed. Rep. of Germany ..... 3102169

[51] Int. Cl.[3] ..... C08L 27/16

[52] U.S. Cl. ..... 524/337; 428/421; 524/389; 524/520

[58] Field of Search ..... 524/91, 336, 337, 389, 524/520, 388, 385; 428/421

[56] References Cited

U.S. PATENT DOCUMENTS 3,454,518 7/1969 Kelly ..... 524/520
3,895,029 7/1975 Ward ..... 524/520
4,022,737 5/1977 Sekmakas ..... 524/520
4,314,004 2/1982 Stoneberg ..... 428/421

*Primary Examiner*—Paul R. Michl
*Attorney, Agent, or Firm*—Felfe & Lynch

[57] ABSTRACT

The present invention provides an aqueous dispersion for the production of corrosion- and weather-resistant coatings on work materials, especially on synthetic fibre fabrics, said aqueous dispersion comprising:

- 20 to 50% by weight polyvinylidene fluoride,
- 20 to 50% by weight water,
- 1.5 to 25% by weight of an acrylic co-polymer,
- 1.5 to 5% by weight of a pigment and/or a filling material,
- 0.05 to 0.75% by weight, referred to the polyvinylidene fluoride, of a light-protection agent and
- 4 to 20% by weight of a low boiling alcohol or of a mixture of a low boiling alcohol and of a high boiling solvent.

The present invention also provides a process for the production of corrosion- and weather-resistant coatings on work materials, wherein the above dispersion is applied to a work material, followed by heating in.

36 Claims, No Drawings

AQUEOUS DISPERSIONS FOR COATING MATERIALS

This application is a continuation, of application Ser. No. 340,472, filed 1/18/82, now abandoned.

This invention relates to an aqueous dispersion for the production of corrosion- and weather-resistant coatings on work materials. More specifically, such coatings can be used on fiber fabrics, especially synthetic fiber fabrics, glass, glass fabrics, metal ceramic and the like. More specifically, the invention relates to such dispersions containing a polyvinylidene fluoride, an acrylic copolymer and a pigment. In additional aspect, the invention relates to a process for the production of corrosion and weather-resistant coatings using such dispersions.

It is already known to provide synthetic fibre fabrics, for example polyester fabrics, with thick layers of polyvinyl chloride. The polyvinyl chloride used for this purpose is rendered soft with the help of additives and, as a rule, contains a proportion of plasticiser of 40 to 60% by weight. In spite of the use of stabilisers and pigments, the surface of the polyvinyl chloride undergoes breakdown and destruction due to the action of light when used in the open, for example as sheetings for heavy goods vehicles or as materials for making inflatable hangars and the like. Due to this breakdown, the polyvinyl chloride becomes brittle, rough and tearable, the result of which is that surfaces coated therewith become very dirty and are also attacked.

It is also known to produce membrane constructional materials, for example glass fabrics coated with polytetrafluoroethylene. These membrane constructional materials have an excellent weathering resistance in the open air and very good dirt-repellent properties and are practically non-inflammable. However, one of their disadvantages is their expensive method of production, which results in very expensive end products. Furthermore, as glass fabrics, it is only possible to use special glass filament fabrics, the threads of which consist of fine filaments and which, consequently, are also expensive. In addition, these substrate fabrics have a substantially smaller stretchability than, for example, polyester fabrics. Therefore, the further tear strength of coated glass fabrics is lower than in the case of corresponding polyester fabrics.

Federal Republic of Germany Patent Specification No. 2,325,304 describes air-drying aqueous polyvinylidene fluoride dispersions which contain polyvinylidene fluoride, an acrylate polymer and optionally pigments, flow adjuvants, solvents, surface-active agents, thickening agents and the like. These dispersions give hard and tough coatings. When applied to synthetic fibre fabrics in layer thicknesses such as are usual for plasticized polyvinyl chloride then rigid products are obtained which are not suitable for heavy goods vehicle sheetings, inflatable hangars, conveyor belts and the like. Furthermore, the wetting agents employed according to this prior art technique increase the tendency of the fibre fabrics to become dirty.

Federal Republic of Germany Patent Specification No. 2,818,385 describes polyvinylidene fluoride shaped bodies with a textile surface finish which are obtained by pressing extruded polyvinylidene fluoride bands at an elevated temperature on to a thermoplastic polyester fleece. The stiff laminated plates thereby obtained can be used as semi-finished materials for the construction of containers. However, because of their rigidity, they are also unsuitable for the abovementioned fields of use of membrane constructional materials.

It is an object of the present invention to provide an aqueous dispersion and a process with which it is possible to form corrosion- and weather-resistant coatings on work materials, especially on synthetic fibre fabrics, so that membrane constructional materials are obtained which are suitable for use as heavy goods vehicle sheetings, for inflatable hangars, tents, covering mats, conveyor belts and the like, whereby, at the same time, the lowest possible impairment of the environment by organic solvents is achieved.

Thus, according to the present invention, there is provided an aqueous dispersion for the production of corrosion- and weather-resistant coatings on work materials, especially on synthetic fibre fabrics, said aqueous dispersion comprising:

- 20 to 50% by weight polyvinylidene fluoride,
- 20 to 50% by weight water,
- 1.5 to 25% by weight of an acrylic co-polymer,
- 1.5 to 5% by weight of a pigment and/or a filling material,
- 0.05 to 0.75% by weight, referred to the polyvinylidene fluoride, of a light-protection agent and
- 4 to 20% by weight of a low boiling alcohol or of a mixture of a low boiling alcohol and of a high boiling solvent.

Surprisingly, the aqueous dispersion according to the present invention, even when applied in comparatively large amounts to synthetic fibre fabrics, gives homogeneous, firmly-adhering and very flexible coatings which are also smooth, glossy and impermeable to water.

They envelop the synthetic fibre fabric very firmly and impart to the product obtained the special advantages and properties of polyvinylidene fluoride, namely, an extraordinarily high chemical resistance, light resistance, heat stability and scratch resistance and also a low tendency to become dirty.

The aqueous dispersion preferably contains the polyvinylidene fluoride in an amount of from 30 to 45% by weight. The polyvinylidene fluoride used preferably has an average primary particle size of less than 0.5 $\mu$m. and may be prepared by the process described in Federal Republic of Germany Patent Specification No. 1,939,852. According to a further preferred embodiment of the present invention, the aqueous dispersion contains 35 to 45% by weight of water.

The acrylic co-polymer present in the aqueous dispersion is preferably a water-soluble co-polymer of acrylic acid and/or methacrylic acid and one or more monomers co-polymerisable therewith, for example, acrylamide, methacrylamide, acrylonitrile, methyl acrylate, methyl methacrylate, ethyl acrylate, ethyl methacrylate, butyl acrylate, butyl methacrylate, styrene, butadiene and/or vinyl acetate. The acrylic co-polymer is preferably used in the form of the ammonium salt. Especially preferably, use is made of the aqueous acrylic co-polymer solutions which are available under the trade name "Glascol HA 4" from Allied Colloids Ltd., Great Britain. These are clear, colourless or pale yellow solutions of the ammonium salts of acrylic co-polymers which have a viscosity of from 30 to 70 poise at 20° C., a solids content of 30±1%, a pH value of 7.5 to 8.5 and a specific weight of 1.07 g./cm$^3$. These acrylic co-polymer solutions form water-resistant, soft and flexible films. The acrylic co-polymers used in the aqueous dispersions according to the present invention bring about an increase of the adhesive strength of the coating masses on to the substrates, as well as an increase of the flexibility and of the soft handle of the laminated material as a whole.

If corrosion- and weather-resistant coatings are to be formed by the application of especially large amounts of the aqueous dispersion, the aqueous dispersion according to the present invention preferably also contains 2.5 to 10% by weight and more preferably 2.5 to 5% by weight, referred to the polyvinylidene fluoride, of a plasticiser, for example, polypropylene adipate, polybutylene adipate, polypropylene sebacate, polybutylene sebacate and/or an ethylene/vinyl acetate co-polymer. It is hereby also recommended to use small amounts, preferably 0.01 to 1% by weight, of an adhesive agent, for example of a silane adhesive agent, such as γ-methacryloxypropyltrimethoxysilane.

In this case, it is recommended to add to the aqueous dispersion an adjuvant solvent which simultaneously serves as an adjuvant solvent for the light protection agent and/or for the plasticiser, for example methyl ethyl ketone, ethyl acetate and/or xylene, this adjuvant solvent preferably being used in an amount of from 1 to 30% by weight.

For the improved wettability of the work material to be coated, the aqueous dispersion according to the present invention contains 4 to 20% by weight and preferably 5 to 15% by weight of a low boiling alcohol, which preferably has a boiling point of not more than 120° C. at normal pressure. Low molecular weight alcohols of this kind which are preferably used according to the present invention include primary, secondary and tertiary aliphatic alcohols containing up to 5 carbon atoms, for example methanol, ethanol, propanol, one of the butanols and especially isopropyl alcohol. The result of the use of this low molecular weight alcohol is that the dispersion readily wets the substrate without disturbing wetting agent residues being introduced in the finished coating. At the same time, this low molecular weight alcohol simplifies the dispersion of the polyvinylidene fluoride. If the drying of the dispersion takes place too quickly, then it is preferable to use the low boiling point alcohol in combination with a solvent which retards drying. For this purpose, it is preferable to use solvents with boiling point ranges of from 120° to 180° C., for example diethylene glycol dimethyl ether, xylene, butyl glycol or mixtures thereof. These higher boiling point solvents can replace up to 50% by weight of the amount of the low boiling point alcohol.

According to a preferred embodiment of the present invention, the aqueous dispersion contains 0.5 to 5% by weight of a thickening agent, for example, a water-soluble ammonium polyacrylate. It is especially preferred to use the aqueous solution of ammonium polyacrylate obtainable from BASF under the trade name "Latekoll AS".

As light-protection agent, the aqueous dispersion according to the present invention contains conventional ultra-violet light protection agents, for example, benzotriazole derivatives and/or light protection agents containing sterically-hindered amino groups. It is especially preferred to use a light protection agent mixture consisting of "Tinuvin P" and "Tinuvin 770", this light protection agent preferably being used as a solution, especially in ethyl acetate.

As pigments or filling materials, according to the present invention, there can be used light- and weather-resistant substrates, such as titanium dioxide of the rutile type, inorganic pigments or metal bronzes.

In order to impart low inflammability to the coatings obtainable from the aqueous dispersions according to the present invention, use can be made of an addition of antimony trioxide to the aqueous dispersion of the present invention, the amount used preferably being from 3 to 7% by weight, referred to the total formulation. An especially marked effect with regard to the low inflammability is achieved by means of a synergistic combination of antimony trioxide and melamine cyanurate. Such an especially effective mixture preferably consists of 1 to 5% by weight of antimony trioxide and 0.5 to 2% by weight of melamine cyanurate, referred to the total formulation, a combination of about 2% by weight of antimony trioxide and about 1% by weight of melamine cyanurate being especially preferred.

The aqueous dispersion according to the present invention has the advantage that it can be produced not only with the use of dry polyvinylidene fluoride but also with the use of centrifugally-moist material. This material, which binds relatively large amounts of water (40% by weight of water) is, for the production of the dispersion, mixed with the components already described (acrylic co-polymer, pigments, filling materials etc.) and gently ground in a ball mill, sand mill or the like, the light protection agent and the plasticiser, each previously dissolved in appropriate solvents, thereby being added. Only in the case of the production of dispersions with an especially high content of polyvinylidene fluoride should a part of the water or the whole of the residual moisture be removed from the centrifugally moist material.

The aqueous dispersion according to the present invention can be used for the production of corrosion- and weather-resistant coatings on any desired kinds of work materials, such as woven, non-woven or knitted planar fibre bodies, especially those made of synthetic fibres, glass, glass fabrics, metal, ceramic and the like. The aqueous dispersion according to the present invention is especially well suited for the coating of polyester fibre fabrics and polyamide fibre fabrics, these fibre fabrics preferably having a weight per unit surface area of 80 to 350 g./m$^2$.

The present invention also provides a process for the production of corrosion- and weather-resistant coatings on work materials, especially on synthetic fibre fabrics, wherein the above-described aqueous dispersion is applied to the work material and, possibly after pre-drying, heated in. The aqueous dispersion is thereby applied to the substrate to be coated by conventional methods of application, for example, painting on, rolling, dipping, spraying or the like, and then dried at a temperature of from 100° to 140° C. and preferably of from 120° to 130° C., the preferred period of drying being from 3 to 6 minutes. Subsequently, the applied coating is heated in at a temperature of from 170° to 210° C. and especially of from 190° to 200° C. for 1 to 3 minutes.

In the case of especially smooth work materials and for increasing the adhesive strength, the work material is, according to the present invention, preimpregnated with a polyvinylidene fluoride latex. For this purpose, it is preferred to use the polyvinylidene fluoride latices described in Federal Republic of Germany Patent Specification No. 1,939,852. The preimpregnation produced in this manner is dried and heated in at temperatures such as are mentioned above with regard to the coatings to be produced. The preimpregnation of the work material with the polyvinylidene fluoride latex can be repeated up to 3 times, each application being dried and heated, although this can also take place after the conclusion of the total pre-impregnation. It is preferable to dry for 3 to 6 minutes at 100° to 140° C. and to heat in for 1 to 3 minutes at 170° to 190° C. There then follows the application of the covering coating in the above-described manner.

According to the present invention, the work material to be coated can also be pre-treated with γ-methacryloxypropyltrimethoxysilane as adhesive agent before carrying out the pre-impregnation.

According to the present invention, per application of the dispersion, depending upon the concentration thereof and the nature of the work material, there are applied amounts of 80 to 200 g./m$^3$. With the help of the aqueous dispersion according to the present invention, both sides of the work materials can be coated simultaneously, for example by a dipping process. An additional surface smoothing, for example with the help of so-called smoothing rollers, or a structuring of the surface with the help of structuring rollers is also possible at temperatures of from 180° to 220° C.

The aqueous dispersions according to the present invention, consisting preponderantly of polyvinylidene fluoride, makes possible a long-lasting coating of, in particular, synthetic fibre fabrics since it does not suffer any decomposition reactions due to weathering influences and thus the decorative appearance of the coated surface remains unchanged.

The aqueous dispersion according to the present invention also has the advantage that it is easy to apply even in comparatively high layer thicknesses and, thanks to the low application temperatures, makes possible the use of high-strength polyester fibre fabrics. The tear strength, as well as the large variety of these fabrics, enables a precise adaptation to the subsequently intended use. The dispersion and the process according to the present invention provide weather-resistant, flexible, smooth, unbroken and dirt-repelling coatings to be produced of high quality. Fabrics coated in this manner are especially useful for use in inflatable hangars, tent roofs and conveying belts, as well as special sheetings of all kinds.

The following Examples are given for the purpose of illustrating the present invention:

EXAMPLE 1

As work material, use is made of a polyester fabric with a weight per unit surface area of 135 g./m$^2$. There is first carried out a pre-impregnation by the application of a polyvinylidene fluoride latex containing 0.1% γ-methacryloxypropyltrimethoxysilane. This is pre-dried for 6 minutes at 130° C. and then heated in for 2 minutes at 210° C. The material is then coated with an aqueous dispersion of the following composition:

30.4% polyvinylidene fluoride (PVDF)
7.6% acrylic co-polymer (Glascol HA4; PVDF: acrylic co-polymer=80:20)
3.0% pigment (titanium dioxide, Kronos 2160)
0.022% light-protection agent (Tinuvin P:770=80:20) in
2.128% ethyl acetate
1.52% polymer plasticiser (Uraplast RA 16) in
1.52% methyl ethyl ketone
9.5% isopropyl alcohol
0.1% adhesive agent (γ-methacryloxypropyltrimethoxysilane)
43.5% water
0.71% thickening agent (Latekoll AS).

Two coatings are applied, followed by drying for 5 to 6 minutes at 130° to 135° C. and then heated in for 2 to 3 minutes at 200° to 210° C. There is thus obtained a polymer coating with a weight per unit surface area of 180 to 210 g./m$^2$ with a smooth, white and unbroken surface.

EXAMPLE 2

Use is made of a polyester fabric with a weight per unit surface area of 275 g./m$^2$, the pre-impregnation thereof being carried out in the manner described in Example 1.

The material is then coated three times with an aqueous dispersion of the following composition:

30.4% polyvinylidene fluoride
7.6% acrylic co-polymer
2.50% aluminium pigment (Stapa Hydrolac W.60 n.L., 65%)
0.022% Tinuvin mixture (P:770=80:20) in
2.128% ethyl acetate
1.52% polymer plasticiser in
1.52% methyl ethyl ketone
9.5% isopropyl alcohol
0.1% adhesive agent (γ-methacryloxypropyltrimethoxysilane)
0.75% thickening agent
43.96% water.

The coated material is then dried for 6 minutes at 120° to 125° C. and subsequently heated in for 3 minutes at 190° to 200° C. A polymer coating produced has a weight per unit surface area of 250 to 270 g./m$^2$, a metallically-shiny, flexible and water-tight membrane constructional material being obtained.

EXAMPLE 3

As work material, use is made of a polyester fabric with a weight per unit surface area of 200 g./m$^2$. The fabric is treated with aqueous 0.1% γ-methacryloxypropyltrimethoxysilane (pH value 3.6, adjusted with acetic acid).

The polyester fabric is then coated three times with an aqueous dispersion of the following composition:

40.0% polyvinylidene fluoride
10.0% acrylic co-polymer (Glascol HA4)
2.8% titanium dioxide Kronos 2160
0.025% Tinuvin mixture in
2.475% ethyl acetate
2.0% polymer plasticiser in
2.0% methyl ethyl ketone
5.0% isopropyl alcohol
0.1% adhesive agent (γ-methacryloxypropyltrimethoxysilane)
35.6% water.

The coated material is dried for 5 minutes at 130° to 135° C. and then heated in for 3 minutes at 190° to 200° C. In this manner, there is produced a polymer coating with a weight per unit surface area of 420 g./m$^2$, a flexible membrane constructional material with a smooth, white and unbroken surface being obtained.

EXAMPLE 4

As work material, there is used a polyester fabric with a weight per unit surface area of 200 g./m$^2$.

The polyester fabric is pre-impregnated with a polyvinylidene fluoride latex which contains 0.1% methacryloxypropyltrimethoxysilane. The material is applied by dipping and coating on, followed by drying for 6 minutes at 130° C. and then by heating in for 3 minutes at 210° C.

The material is then coated with an aqueous dispersion which has the following composition:

34.45% polyvinylidene fluoride
8.64% acrylic co-polymer
2.4% pigment (titanium dioxide Kronos 2160)
0.025% light-protection agent in
2.475% ethyl acetate
3.445% polymer plasticiser (Wacker Copolymer VAE 631) in
18.78% xylene
11.62% isopropyl alcohol
0.1% adhesive agent
23.065% water.

The coated material is dried for 5 minutes at 125° C. and then heated in for 3 minutes at 205° C. After coating three times, the applied amount of polymer is about 380 g./m$^2$, a very flexible, smooth membrane constructional material being obtained.

EXAMPLE 5

Use is made of the polyester fabric described in Example 4 and this is pre-impregnated in the manner described therein. The pre-impregnated polyester fabric is then coated three times with an aqueous dispersion of the following composition:

46.00% polyvinylidene fluoride (PVDF)
11.50% acrylic co-polymer (Glascol HA4, PVDF:Glascol HA4=80:20)
3.22% pigment (titanium dioxide Kronos 2160, 7% referred to the PVDF)
0.03% light-protection agent (Tinuvin P:770, 0.065% referred to the PVDF) in
2.85% ethyl acetate
2.30% plasticiser (Uraplast RA 16.5% referred to the PVDF) in
2.30% methyl ethyl ketone
4.87% isopropyl alcohol
0.10% adhesive agent (γ-methacryloxypropyltrimethoxysilane)
26.83% water.

A polymer application of 550 to 600 g./m$^2$ is obtained.

EXAMPLE 6

Use is made of the polyester fabric described in Example 1 and the pre-impregnation is carried out in the manner described therein. The pre-impregnated polyester fabric is then coated three times with an aqueous dispersion of the following composition:

20.00% polyvinylidene fluoride (PVDF)
20.00% acrylic co-polymer (Glascol HA4, PVDF:Glascol HA4=50:50)
1.50% pigment (titanium dioxide Kronos 2160, 7.5% referred to the PVDF)
0.01% light-protection agent (Tinuvin P: 770=80:20, 0.05% referred to the PVDF) in
0.99% ethyl acetate
1.00% plasticiser (Uraplast RA 16.5% referred to the PVDF) in
1.00% methyl ethyl ketone
6.00% isopropyl alcohol
0.10% adhesive agent (γ-methacryloxypropyltrimethoxysilane)
49.40% water.

A polymer application of 250 to 350 g./m$^2$ is obtained.

EXAMPLE 7

Use is made of the polyester fabric described in Example 3 but a pre-impregnation is not carried out.

The polyester fabric is coated three times with an aqueous dispersion of the following composition:

35.00% polyvinylidene fluoride (PVDF)
8.75% acrylic co-polymer (Glascol HA4, PVDF:Glascol HA4=80:20)
2.45% pigment (titanium dioxide Kronos 2160, 7% referred to the PVDF)
0.2625% light-protection agent (Tinuvin P:770=80:20, 0.75% referred to the PVDF) in
4.9875% ethyl acetate
3.50% plasticiser (Uraplast RA 16, 10% referred to the PVDF) in
3.50% methyl ethyl ketone
18.00% isopropyl alcohol
0.10% adhesive agent (γ-methacryloxypropyltrimethoxysilane)
23.45% water.

A polymer application of 360 to 420 g./m$^2$ is obtained.

EXAMPLE 8

The polyester fabric described in Example 2 is used without pre-impregnation and this is coated three times with an aqueous dispersion of the following composition:

30.00% polyvinylidene fluoride (PVDF)
1.58% acrylic co-polymer (Glascol HA4, PVDF:Glascol HA4=95:5)
2.10% pigment (titanium dioxide Kronos 2160, 7% referred to the PVDF)
0.03% light-protection agent (Tinuvin P:770=80:20, 0.1% referred to the PVDF) in
2.97% ethyl acetate
10.00% isopropyl alcohol
3.00% plasticiser (Wacker VAE 631, 10% referred to the PVDF) in
27.00% xylene
0.10% adhesive agent (γ-methacryloxypropyltrimethoxysilane)
43.22% water.

There is produced a polymer application of 250 to 330 g./m$^2$, a flexible, water-tight coating being obtained.

EXAMPLE 9

Use is made of a polyester fabric with a weight per unit surface area of 200 g./m$^2$ which is coated three times with an aqueous dispersion of the following composition:

40.00% polyvinylidene fluoride
10.00% acrylic acid co-polymer (Glascol HA4)
2.80% titanium dioxide Kronos 2160
0.025% Tinuvin mixture in
2.475% ethyl acetate
2.00% polymer plasticiser in
2.00% methyl ethyl ketone
2.50% isopropyl alcohol
2.50% butyl glycol 0.10% adhesive agent (γ-methacryloxypropyltrimethoxysilane)

35.60% water.

In this manner, there is obtained a polymer application of 410 to 430 g./m$^2$.

EXAMPLE 10

For demonstrating the low inflammability of the coating, use is made of a polyester fabric identical to that used in Example 9 and this is coated three times with the dispersion also described in Example 9 but in which 3.0% by weight of the water had been replaced by 2.0% by weight of antimony trioxide (Stibiox) and 1.0% by weight of melamine cyanurate.

The thus coated fabric with a polymer application of 425 g./m$^2$ proved to be considerably less inflammable in comparison with the other coatings, using the flame test according to German Industrial Standard DIN 4102.

It will be understood that the specification and examples are illustrative but not limitative of the present invention and that other embodiments within the spirit and scope fo the invention will suggest themselves to those skilled in the art.

What is claimed is:

1. An aqueous dispersion for the production of corrosion- and weather-resistant coatings on work materials, especially synthetic fiber fabrics, said aqueous dispersion comprising:

20 to 50% by weight polyvinylidene fluoride, 20 to 50% by weight water, 1.5 to 25% by weight of an acrylic co-polymer in the form of a water-soluble co-polymer of acrylic acid and/or methacrylic acid and one or more monomers co-polymerizable therewith and selected from the group consisting of acrylamide, methacrylamide, acrylonitrile, methyl acrylate, methyl methacrylate, ethyl acrylate, ethyl methacrylate, butyl acrylate, butyl methacrylate, styrene, butadiene and vinyl acetate, 1.5 to 5% by weight of a pigment and/or a filling material, 0.05 to 0.75% by weight, referred to the polyvinylidene fluoride, of a UV-light-protection agent and 4 to 20% by weight of a low boiling alcohol or of a mixture of a low boiling alcohol and of a high boiling solvent said mixture containing up to 50% of the high boiling solvent.

2. Aqueous dispersion as claimed in claim 1, additionally containing 2.5 to 10% by weight, referred to the polyvinylidene fluoride, of a plasticizer.

3. Aqueous dispersion as claimed in claim 1, additionally containing 0.01 to 1% by weight of an adhesive agent.

4. Dispersion as claimed in claim 1, additionally containing 1 to 30% by weight of an adjuvant solvent for the light-protection agent and/or for the plasticizer.

5. Dispersion as claimed in claim 1, wherein it contains 30 to 45% by weight of polyvinylidene fluoride.

6. Dispersion as claimed in claim 1, wherein the polyvinylidene fluoride present therein has an average primary particle size of less than 0.5 μm.

7. Dispersion as claimed in claim 1, wherein the acrylic co-polymer is present in the form of an ammonium salt.

8. Dispersion as claimed in claim 1, wherein it contains 2.5 to 10% by weight, referred to the polyvinylidene fluoride, of a plasticizer.

9. Dispersion as claimed in claim 2, wherein the plasticizer is polypropylene adipate, polybutylene adipate, polypropylene sebacate, polybutylene sebacate and/or an ethylene/vinyl acetate co-polymer.

10. Dispersion as claimed in claim 1, wherein it contains 5 to 15% by weight of the low boiling alcohol or a mixture of low boiling alcohol and high boiling solvent.

11. Dispersion as claimed in claim 1, wherein the low boiling alcohol is an alcohol with a boiling point of up to 120° C. at normal pressure.

12. Dispersion as claimed in claim 11, wherein the low boiling alcohol is a primary, secondary or tertiary aliphatic alcohol containing up to 5 carbon atoms.

13. Dispersion as claimed in claim 12, wherein the low boiling alcohol is isopropyl alcohol.

14. Dispersion as claimed in claim 1, wherein the high boiling solvent used has a boiling point within the range of from 120° to 180° C.

15. Dispersion as claimed in claim 14, wherein the high boiling solvent is diethylene glycol dimethyl ether, xylene, butyl glycol or a mixture thereof.

16. Dispersion as claimed in claim 3, wherein the adhesive agent is a silane adhesive.

17. Dispersion as claimed in claim 16, wherein the adhesive agent is γ-methacryloxypropyltrimethoxysilane.

18. Dispersion as claimed in claim 4, wherein the adjuvant solvent is methyl ethyl ketone, ethyl acetate and/or xylene.

19. Dispersion as claimed in claim 1, wherein it additionally contains 0.5 to 5% by weight of a thickening agent.

20. Dispersion as claimed in claim 19, wherein the thickening agent is a water-soluble ammonium polyacrylate.

21. Dispersion as claimed in claim 1, wherein, as light-protection agent, it contains a benzotriazole derivative and/or an ultra-violet light protection agent containing sterically hindered amino groups.

22. Dispersion as claimed in claim 1, wherein it additionally contains antimony trioxide.

23. Dispersion as claimed in claim 22, wherein it additionally contains melamine cyanurate.

24. Dispersion as claimed in claim 23, wherein it contains 1 to 5% by weight of antimony trioxide and 0.5 to 2% by weight of melamine cyanurate.

25. Process for the production of corrosion- and weather-resistant coatings on work materials which process comprises applying to the work material a dispersion as claimed in claim 1 and then heating the dispersion into said work material.

26. Process as claimed in claim 25, wherein the work material is a synthetic fiber fabric.

27. Process as claimed in claim 25, wherein the applied dispersion is pre-dried at 100° to 140° C. and is then heated in at 170° to 210° C.

28. Process as claimed in claim 27, wherein the applied dispersion is pre-dried for 3 to 6 minutes and then heated in for 1 to 3 minutes.

29. Process as claimed in claim 25, wherein the dispersion is applied several times, the coatings in each case being pre-dried at 100° to 140° C. for 3 to 6 minutes and subsequently heated in for 1 to 3 minutes at 170° to 210° C.

30. Process as claimed in claim 25, wherein the synthetic fiber fabric is pre-impregnated with a polyvinylidene fluoride latex.

31. Process as claimed in claim 25, wherein the synthetic fiber fabric is pre-impregnated with a polyvinylidene fluoride latex which contains 0.1% γ-methacryloxypropyltrimethoxysilane.

32. Process as claimed in claim 25, wherein the material, after the pre-impregnation, is pre-dried at 100° to 140° C. and subsquently heated in at 170° to 210° C.

33. Process as claimed in claim 25, wherein the pre-impregnated material is pre-dried for 3 to 6 minutes and heated in for 1 to 3 minutes.

34. Process as claimed in claim 25, wherein the pre-impregnated material, in the case of several applications, is, in each case, pre-dried for 3 to 6 minutes at 100° to 140° C. and subsequently heated in for 1 to 3 minutes at 170° to 210° C.

35. Corrosion- and weather-resistant work material and, applied thereonto, a coating from an aqueous dispersion as claimed in claim 1.

36. Corrosion- and weather-resistant synthetic fiber fabric, comprising a synthetic fiber fabric and a coating thereon made from an aqueous dispersion as claimed in claim 1.

* * * * *